US011910939B1

(12) United States Patent
Rummage

(10) Patent No.: US 11,910,939 B1
(45) Date of Patent: Feb. 27, 2024

(54) WALL MOUNTED STORAGE RACK TO STORE AND DISPLAY STATIC AND REMOTE CONTROL SCALE VEHICLES

(71) Applicant: Judd Rummage, San Mateo, CA (US)

(72) Inventor: Judd Rummage, San Mateo, CA (US)

( * ) Notice: Subject to any disclaimer, the term of this patent is extended or adjusted under 35 U.S.C. 154(b) by 0 days.

(21) Appl. No.: 18/085,549

(22) Filed: Dec. 20, 2022

(51) Int. Cl.
*A47F 7/00* (2006.01)
*A47B 46/00* (2006.01)

(52) U.S. Cl.
CPC ..... *A47F 7/00* (2013.01); *A47B 46/005* (2013.01); *A47F 2007/0092* (2013.01)

(58) Field of Classification Search
CPC .. A47F 2007/0092; A47F 7/00; A47F 5/0869; A47B 46/005
USPC ..... 248/922
See application file for complete search history.

(56) References Cited

U.S. PATENT DOCUMENTS 946,833 A * 1/1910 Bake ..... A47G 25/0685 211/32
1,091,812 A * 3/1914 Corthell ..... A47F 7/06 211/32
1,124,714 A * 1/1915 Denning ..... A47F 7/06 211/32
4,410,159 A * 10/1983 McVicker ..... F16M 11/10 248/922
D327,458 S 6/1992 Martinell
5,165,644 A * 11/1992 Allen ..... F16M 11/08 248/924
5,429,336 A * 7/1995 Ko ..... F16M 13/00 248/278.1
5,553,820 A * 9/1996 Karten ..... F16M 11/10 248/181.2
5,738,316 A * 4/1998 Sweere ..... F16M 11/2092 248/920
5,799,917 A * 9/1998 Li ..... F16M 13/022 248/921
6,095,476 A * 8/2000 Mathis ..... F16M 11/10 248/371
6,315,258 B1 * 11/2001 Myler ..... A47F 5/083 211/95
6,609,272 B1 * 8/2003 Lee ..... E05D 11/082 16/338

(Continued)

*Primary Examiner* — Stanton L Krycinski
(74) *Attorney, Agent, or Firm* — OMNIVAULT LLC; Robert Denis

(57) ABSTRACT

A storage rack assembly configured for mounting to a wall surface, the assembly comprising a mounting bracket comprising an outer surface configured to affix to the wall surface and an inner surface opposite the outer surface, a set of support arms configured to extend in a generally diverging relationship from the mounting bracket and a platform comprising an upper surface and a lower surface. The platform is configured for independent pivotal movement with respect to the mounting bracket about respective pivot axes arranged in angular relationship to each other. The mounting bracket comprises a base plate, and a pivot bracket secured the base plate, with a proximal portion of each of the support arms positioned in captive relationship between the pivot bracket and base plate for independent pivotal movement. The platform defines an H-shaped generally planar surface for resting an object. The platform comprises a foam pad affixed to the upper surface of the platform to provide greater stability for the object resting on the platform.

9 Claims, 10 Drawing Sheets

(56) References Cited

U.S. PATENT DOCUMENTS 6,769,657 B1 * 8/2004 Huang ..... F16M 13/022 248/278.1
7,404,535 B2 * 7/2008 Mossman ..... F16M 11/24 248/323
7,448,584 B2 * 11/2008 Chen ..... F16M 13/02 248/920
7,487,943 B1 * 2/2009 Gillespie ..... F16M 11/10 248/920
7,510,155 B2 * 3/2009 Huang ..... F16M 11/2014 248/278.1
7,540,457 B2 * 6/2009 Oddsen, Jr. ..... F16M 13/022 248/278.1
7,597,302 B2 * 10/2009 Lee ..... F16M 11/2021 248/371
7,669,822 B2 3/2010 Kluge et al.
7,690,605 B2 * 4/2010 Lee ..... F16M 11/2021 248/371
7,954,777 B2 * 6/2011 Bohm ..... H01Q 1/1221 403/57
7,984,888 B2 * 7/2011 Park ..... F16M 11/38 248/920
8,245,856 B1 * 8/2012 Pappin ..... A63H 17/00 211/13.1
8,292,094 B2 10/2012 Morton
8,328,151 B2 * 12/2012 Gwag ..... F16M 11/10 248/922
8,727,143 B2 * 5/2014 Flickinger ..... A47F 7/00 211/85.3
8,827,226 B2 * 9/2014 Townsend ..... F16M 11/2092 248/920
D747,724 S * 1/2016 Kulkarni ..... D14/452
D887,241 S 6/2020 Woller
11,192,219 B2 * 12/2021 Prinzivalli ..... F16M 11/041
2003/0122046 A1 * 7/2003 Huong ..... E05D 11/087 248/922
2007/0152111 A1 * 7/2007 Tang ..... G06F 1/1601 248/922

* cited by examiner

WALL MOUNTED STORAGE RACK TO STORE AND DISPLAY STATIC AND REMOTE CONTROL SCALE VEHICLES

FIELD OF THE INVENTION

This disclosure generally relates to displaying and storing static and remote control scale vehicles. Specifically, this disclosure relates to a wall mounted storage rack to display and store surface, air, and water based remote control scale vehicles.

BACKGROUND

Remote Control Vehicle Building, Sport Driving, and Racing are fast-growing emerging sports in the world of radio-controlled vehicles. Radio-controlled vehicles (or "RC vehicles") are miniature model cars, vans, buses, trucks or buggies that can be controlled from a distance using a specialized transmitter or remote. The term "RC" may refer to both "remote controlled" and "radio controlled", where "remote controlled" includes vehicles that are controlled by radio waves, infrared waves or a physical wire connection.

RC vehicles may be powered by various sources, including but not limited to, electric motors using rechargeable nickel-cadmium, nickel metal hydride, or lithium polymer cells, brushed electric motors, brushless electric motors, fuel-powered glow plug engines which may be fueled by a special mixture of nitromethane, methanol, and oil (referred to as "nitro" cars), and small gasoline engines.

RC vehicles may include all wheeled vehicles, including both on-road and off-road vehicles. Off-road models, which are built with fully functional off-road suspensions and a wide tire selection, can be used on various types of terrain. On-road cars, with a much less robust suspension, may be more limited paved surfaces. Additionally, there are also rally cars, which fall somewhere between on-road and off-road and can be driven on gravel, dirt or other loose surfaces. In the past decade, advances in on-road vehicles have made their suspension as adjustable as many full-scale race cars, today. Other RC vehicles include air based and water based vehicles, including helicopters, quad copters, propeller planes, jet planes, propeller boats, jet boats, submarines, submersibles, amphibious vehicles, and the like.

RC vehicles may often include tires that are filled with foam, rather than air or solid rubber. Accordingly, about 95% of RC vehicle tires are supported by foam or another semi rigid material. The foam or semi-rigid material may cause a "flat spot" where the vehicle's tires and foams meet any flat surface if the full weight of the vehicle is on the tires for an extended period of time. Although flat spots may not cause damage to tires, flat spots may still nonetheless affect vehicle performance.

In the world of RC Racing, fractions of a second can determine the winner of a race. Thus, it is imperative for RC vehicle racers and enthusiasts to maintain their vehicles in optimal condition in between races. When the full weight of a vehicle is sitting on the foam filled tires, the foam in the tires may flatten or form a flat spot or dent over time at the point of contact of the tires and the surface on which the vehicle is stationed. Additionally, RC vehicles comprise of delicately tuned suspensions that also need to be maintained in optimal condition in between races. When the full weight of a vehicle is sitting on a flat surface, the suspension, including the suspension springs, may become damaged over time. Accordingly, there is a need for a means to store and display RC vehicles in a manner that maintains the vehicles in optimal condition in between races or repairs, which addresses the specific issues of preventing damage to the RC vehicles wheels and suspension caused when the vehicle is stored on a flat surface. The present disclosure includes a wall mounted storage rack to display and store RC vehicles that is configured to prevent damage to the vehicle tires and suspension and maintain optimal vehicle condition in between races and maintenance.

Accordingly, there is a need for a storage rack that stores a vehicle without contact with the tires at the wheels that would compress the semi rigid materials that are used in place of air to support or fill the tires over time while stored, leading to abnormal or substandard performance of the vehicle. The present invention relates generally to storage rack arrangements for storage of hobby vehicles on an associated wall or like supporting surface, and more particularly to a storage rack assembly configured for wall-mounted storage of a radio-controlled hobby vehicles or like article, wherein the assembly includes a pair of support arms movable about respective pivot axes arranged in a planar relationship. The support arms can he positioned to provide the assembly with a relatively compact configuration to display radio-controlled toy vehicles without contact with the tires of the wheels that would lead to abnormal wear or damage to the tires.

SUMMARY OF THE INVENTION

A storage rack assembly embodying the principles of the present invention is particularly suited for wall-mounted storage of radio-controlled hobby vehicles, and to this end, includes a pair of support arms which can extend in generally diverging relationship from an associated mounting bracket. Notably, because the support arms are configured for independent pivotal movement with respect to the mounting bracket about respective pivot axes arranged in angular relationship to each other, the storage rack assembly can desirably be easily manipulated, and folded and collapsed to a compact configuration which promoted efficient storage, shipment, and display such as by hanging, for display.

In accordance with the illustrated embodiment, the present hobby vehicle storage rack assembly comprises a mounting bracket configured for mounting on an associated support surface such as a wall or the like. The storage rack assembly further includes a pair of support arms pivotally mounted on the pivot bracket with a planar surface fixed with slotted tabs allowing pivotal movement about respective pivot axis. In the illustrated embodiment, the mounting bracket includes a base plate, and a support bracket secured thereto, with a proximal portion of each of the support arms positioned in captive relationship between the pivot bracket and base plate for independent pivotal movement of the platform/cradle on which the vehicle is meant to rest.

BRIEF DESCRIPTION OF THE DRAWINGS

The following drawings are intended to serve as exemplary embodiments of the features disclosed in the present disclosure.

DETAILED DESCRIPTION OF DRAWINGS

Figure 1:
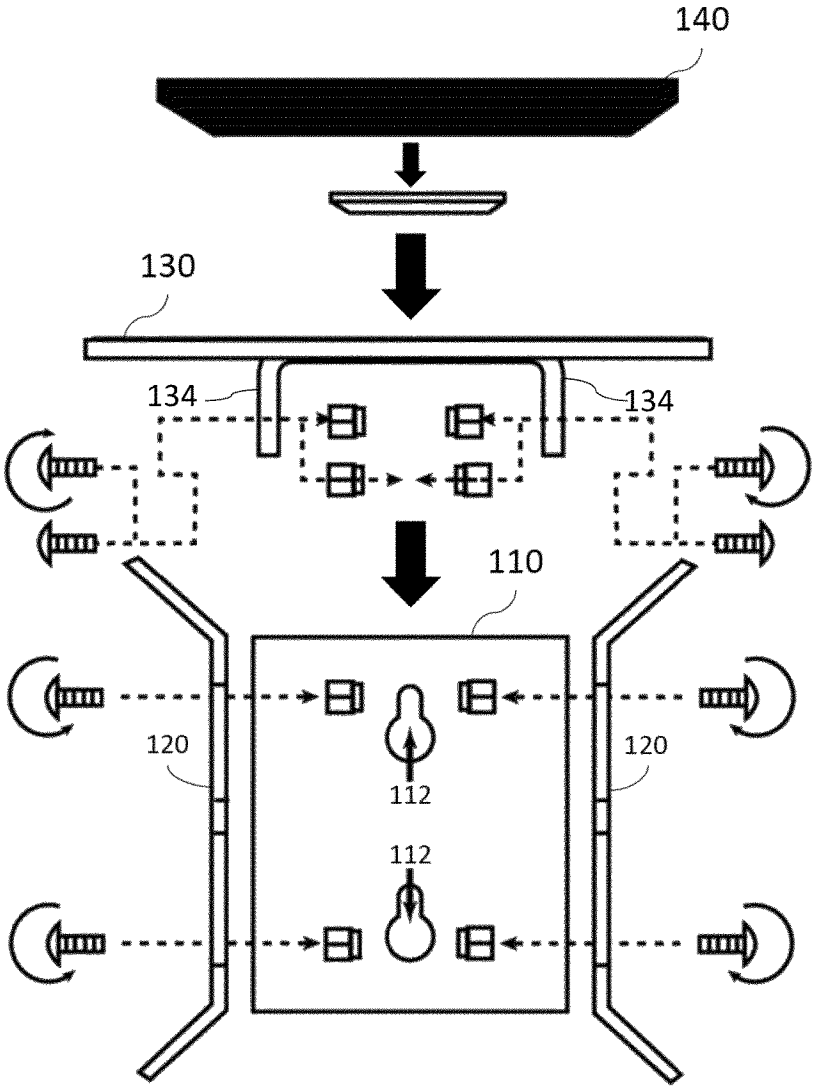
FIG. 1 is a diagram illustrating an exemplary wall mounted storage rack for storing and displaying scale vehicles.

The description of illustrative embodiments according to principles of several illustrative embodiments is intended to be read in connection with the accompanying drawings, which are to be considered part of the entire written description. In the description of embodiments disclosed herein, any reference to direction or orientation is merely intended for convenience of description and is not intended in any way to limit the scope of the present invention. Relative terms such as "lower," "upper," "horizontal," "vertical," "above," "below," "up," "down," "top" and "bottom" as well as derivative thereof (e.g., "horizontally," "downwardly," "upwardly," etc.) should be construed to refer to the orientation as then described or as shown in the drawing under discussion. These relative terms are for convenience of description only and do not require that the apparatus be constructed or operated in a particular orientation unless explicitly indicated as such. Terms such as "attached, " "affixed," "connected," "coupled," "interconnected," and similar refer to a relationship wherein structures are secured or attached to one another either directly or indirectly through intervening structures, as well as both movable or rigid attachments or relationships, unless expressly described otherwise. Moreover, the features and benefits are illustrated by reference to certain exemplified embodiments and may not apply to all embodiments.

Accordingly, the invention expressly should not be limited to such exemplary embodiments illustrating some possible non-limiting combination of features that may exist alone or in other combinations of features; the scope of the claimed invention being defined by the claims appended hereto.

This disclosure describes the best mode or modes of practicing the intervention as presently contemplated. This description is not intended to be understood in a limiting sense but provides an example of the invention presented solely for illustrative purposes by reference to the accompanying drawings to advise one of ordinary skill in the art of the advantages and construction of the invention. In the various views of the drawings, like reference characters designate like or similar parts. The various embodiments described herein describe a wall mounted storage rack to display and store scale vehicles.

RC vehicles often comprise of tires that are filled with foam, which may be susceptible to developing flat spots over time if the full weight of the RC vehicle is sitting on the wheels. Further, RC vehicles comprise suspensions that include springs that may be susceptible to damage over time if the full weight of the RC vehicle is sitting directly on a flat surface. The present disclosure includes a wall mounted storage rack for RC vehicles configured to prevent damage to RC vehicle wheels and suspensions.

Furthermore, in addition to wheeled RC vehicles, other types of RC vehicles may likewise comprise of delicate parts. Accordingly, RC watercraft may comprise of delicate components, including propellers, rudders, and the like, that may susceptible to damage if not properly stored when not in used. Further, RC helicopters and planes may also comprise of delicate components, including propellers, blades, skids, landing gears, and the like, that may likewise be susceptible to damage if the vehicle is not properly stored when not in use. Accordingly, the present invention is configured to prevent damage to the delicate components of many types of scale vehicles.

FIG. 1 is a diagram illustrating an exemplary elements-exploded view of a wall mounted storage rack 100 for storing and displaying scale vehicles. In accordance with FIG. 1, the wall mounted storage rack 100 may include, but is not limited to, a base 110, a set of support arms 120, a platform 130, and a foam pad 140.

With continued to reference to FIG. 1, the wall mounted storage rack 100 may comprise of a base 110 configurable to be coupled a to a wall surface. In accordance with the illustrated embodiment, the present hobby vehicle storage rack assembly comprises a mounting bracket configured for mounting on an associated support surface such as a wall or the like.

Figures 2A, 2B:
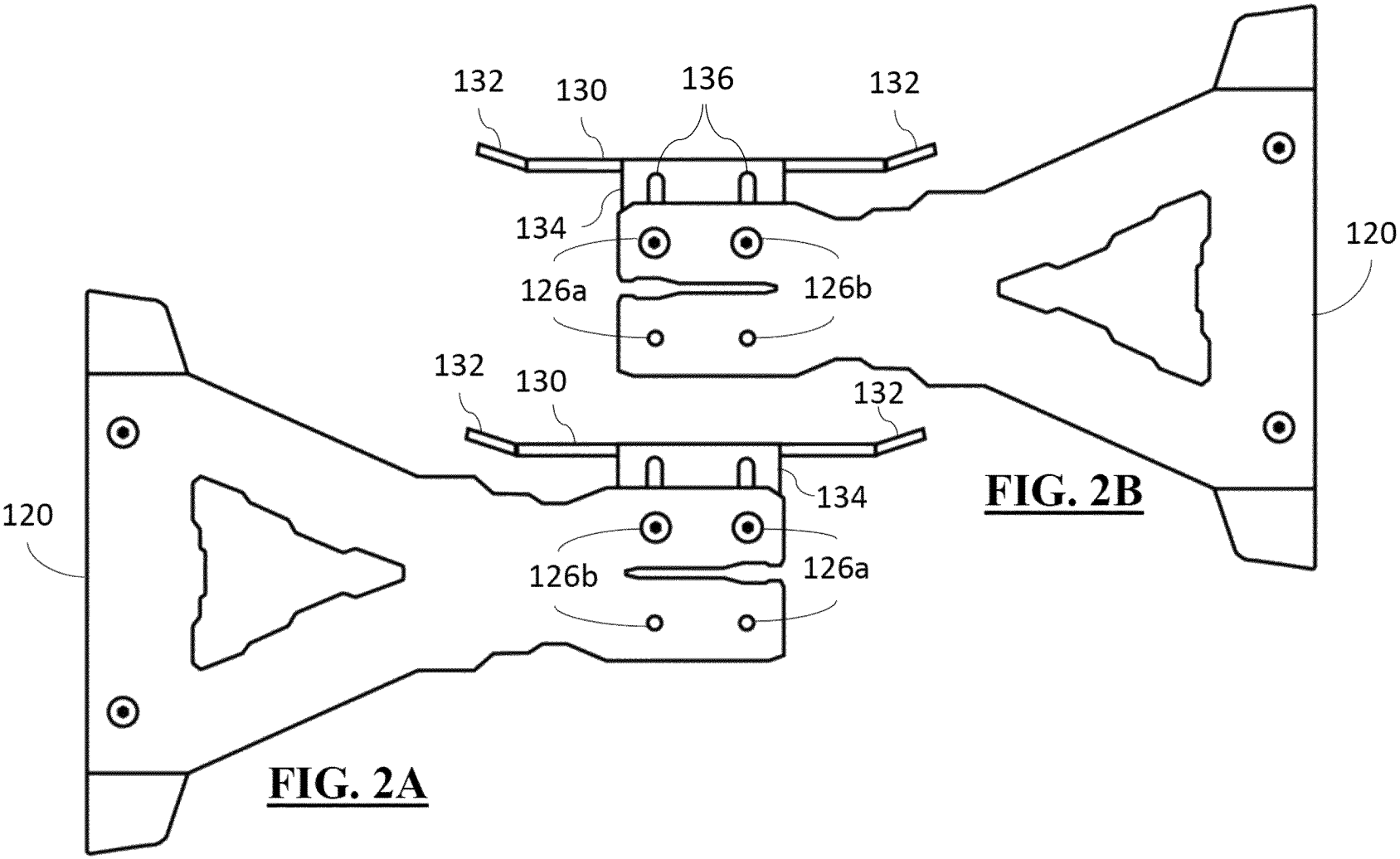
FIG. 2A is a diagram illustrating left side view of an exemplary wall mounted storage rack for storing and displaying scale vehicles.
FIG. 2B is a diagram illustrating a right side view of an exemplary wall mounted storage rack for storing and displaying scale vehicles.

FIG. 2A is a diagram illustrating left side view of an exemplary wall mounted storage rack for storing and displaying collectibles.

FIG. 2B is a diagram illustrating a right side view of an exemplary wall mounted storage rack for storing and displaying collectibles.

Figure 2C:
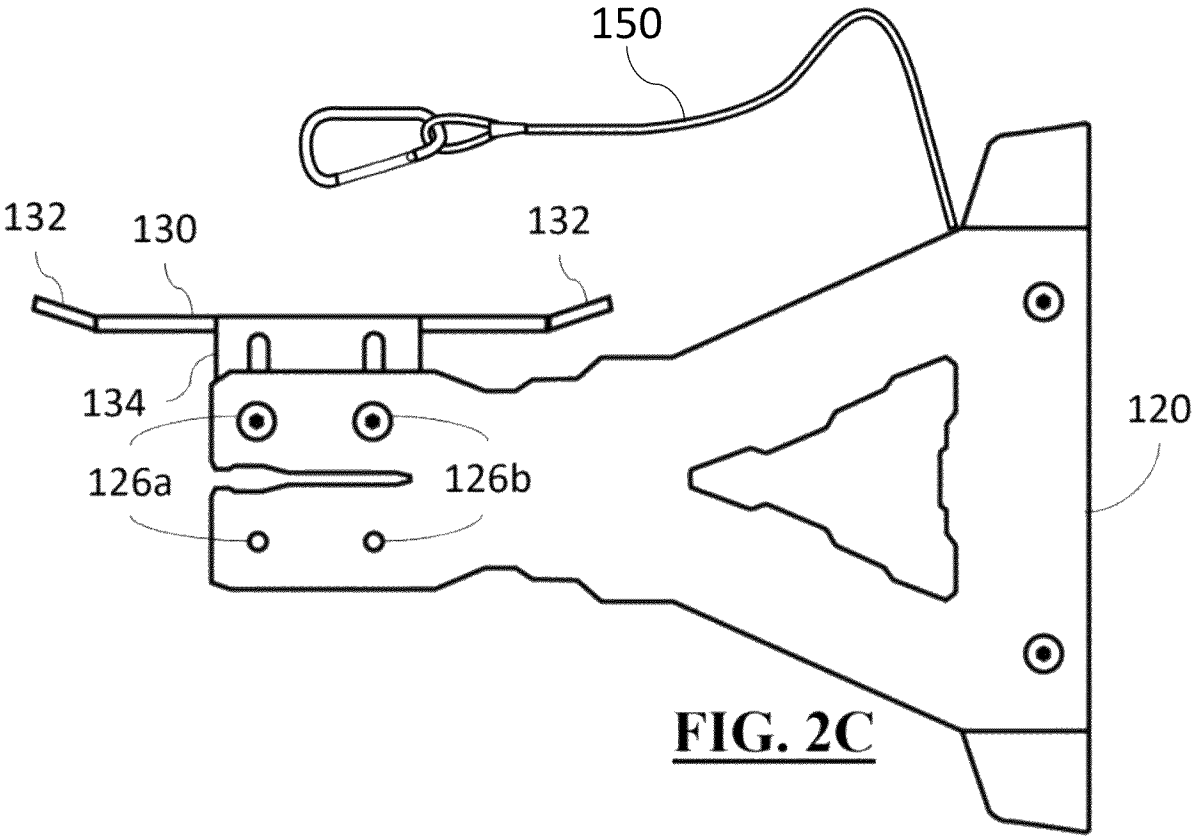
FIG. 2C is a diagram illustrating an exemplary wall mounted storage rack comprising a vehicle leash.
Figure 3:
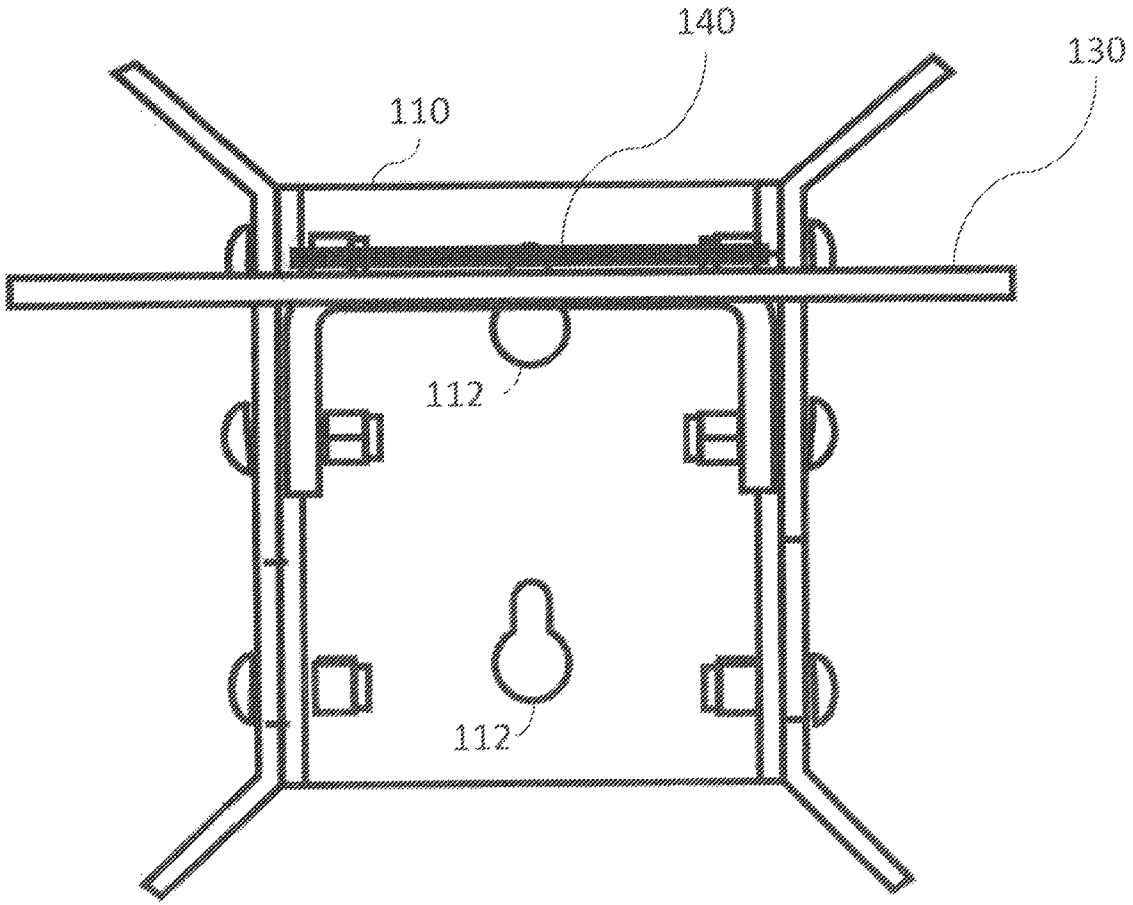
FIG. 3 is a diagram illustrating a front side view of an exemplary wall mounted storage rack mounted to a wall surface.

FIG. 2C is a diagram illustrating an exemplary wall mounted storage rack comprising a vehicle leash FIG. 3 is a diagram illustrating a front view of exemplary wall mounted storage rack mounted to a wall surface.

Figure 4:
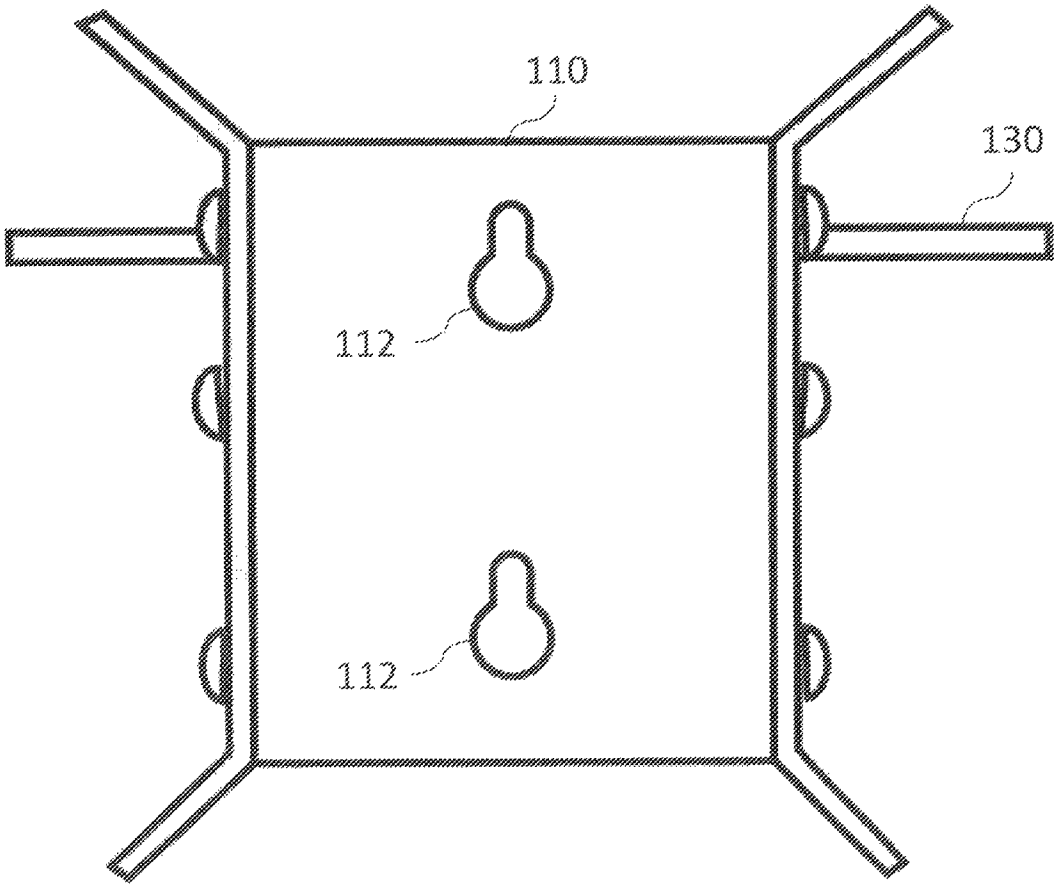
FIG. 4 is a diagram illustrating a rear view of an exemplary wall mounted storage rack mounted to a wall surface.

FIG. 4 is a diagram illustrating a rear view of an exemplary wall mounted storage rack mounted to a wall surface.

Figure 5:
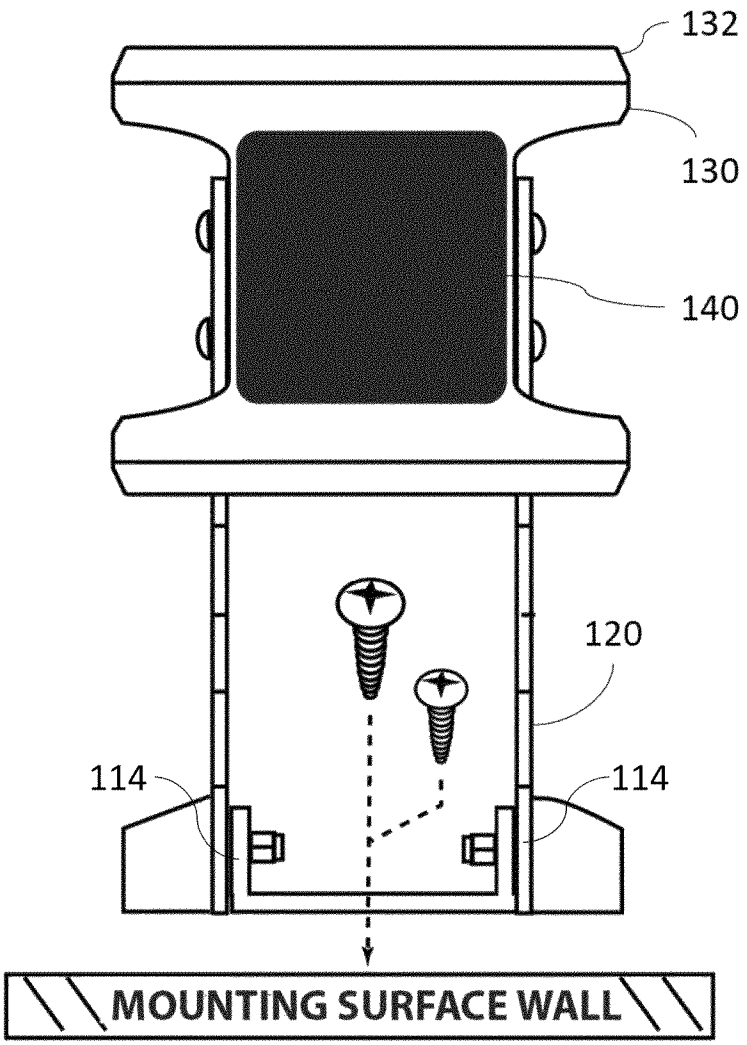
FIG. 5 is a diagram illustrating a top view of an exemplary wall mounted storage rack mounted to a wall surface.

FIG. 5 is a diagram illustrating a top view of an exemplary wall mounted storage rack mounted to a wall surface.

Figure 5B:
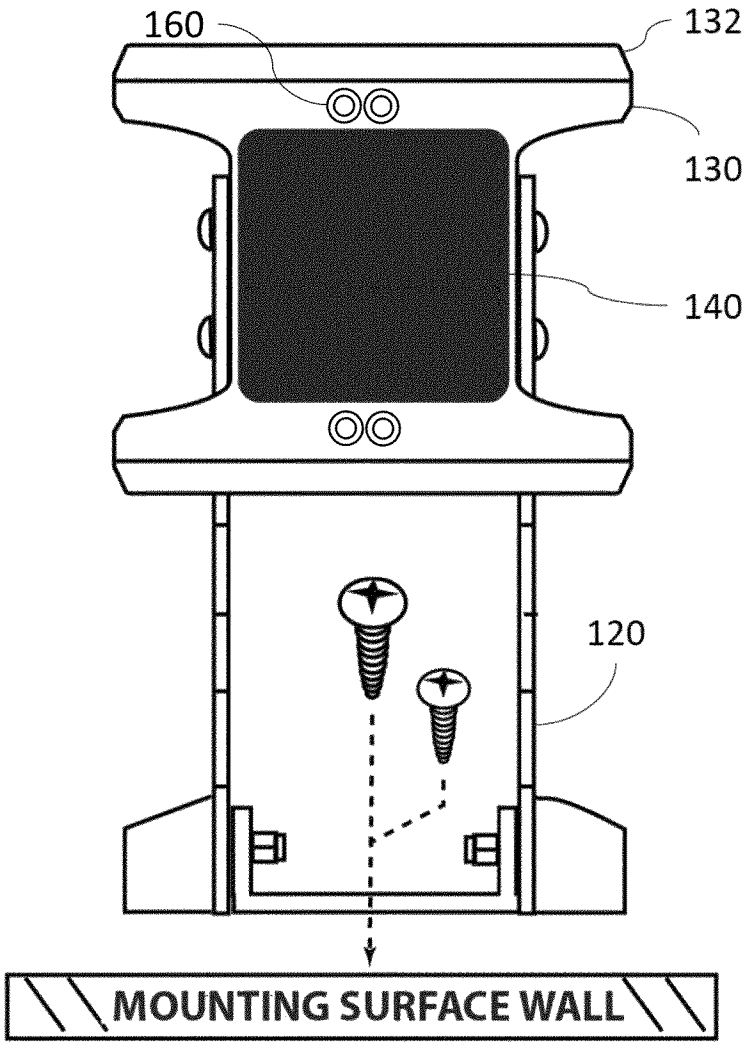
FIG. 5B is a diagram illustrating an exemplary wall mounted storage rack comprising at least one optical sensor

FIG. 5B is a diagram illustrating an exemplary wall mounted storage rack comprising at least one optical sensor.

With continued reference to FIGS. 1-5, the wall mounted storage rack 100 may further comprise a set of support arms 120. Accordingly, the pair of support arms 120 may be pivotally mounted on the pivot bracket 134 for independent, pivotal movement about respective pivot axes. In the illustrated embodiment in FIG. 1, the mounting bracket includes a base plate, and a support bracket secured thereto, with a proximal portion of each of the support arms 120 positioned in captive relationship between the pivot bracket 134 and base plate 110 for independent pivotal movement of the platform with respect to the arms 120. In one embodiment, the base plate 110 may comprise form metallic facing member and a backing member molded from polymeric material. In the preferred embodiment, the storage rack comprises raw cold rolled steel.

With continued reference to FIG. 2A and FIG. 2B, the platform 130 is shown coupled to a pivot bracket 134. The pivot bracket 134 is shown comprising a pair of slotted tabs 136 enabling the height and/or angle of the platform 130 to be adjusted with respect to the support arms 120. Accordingly, the platform 130 may be raised or lowered with respect to the support arms 120 by adjusting the position of bolts along each slotted tab of the pair of slotted tabs 136. Further, the pivot bracket 134 enables the platform 130 to pivot from a first position to a second position with respect to the support arms 120.

In an embodiment, the first position comprises a wall-mounted mode position, wherein the base 110 may be mounted to a wall or a similar mounting surface. To configure the storage rack assembly into a wall-mount mode position (first position) the pivot bracket 134 may be secured to the support arms 120 via a proximal bolt opening 126*a* and distal bolt opening 126*b*. In an embodiment, the second position comprises a table top mode position, wherein the support assemble may be configured to rest on a table-top or similar flat resting surface. To configure the storage rack assembly into a table-top mode position (second position) the pivot bracket 134 may be secured to the support arms 120 via both proximal bolt openings 126*a* of each of the support arms 120. Further, in both the wall-mounted mode position as well as the table top mode position, the height and angle of the platform 130 may be adjusted with respect to the arms 120. Accordingly, the bolts engaging the proximal bolt openings 126*a* and the distal bolt openings 126*b* may be loosened/tightened to achieve a desired angle and/or height of the platform 130 with respect to the support arms 120.

In the preferred embodiment, the arms and baseplate are configured in a generally fixed position. Accordingly, in said embodiment, the platform/cradle 130 is configured to adjust between several different positions and angles.

In the preferred form, the mounting bracket defines a pair of generally planar surfaces arranged at an angle, with the pivot axes of the support arms arranged in angular relationship to each other. The pivot axes are preferably intersecting and arranged at an obtuse angle with respect to each other.

By this arrangement, each of the support arms is pivotally movable between a first, raised position, and a second, lowered position. In the lowered position of each arm, the arms extend in generally diverging relationship from the mounting bracket, with distal portions of the support arms thus configured to cooperate with each other to support an associated object. Of course, it is within the purview of the present invention that other articles can be similarly positioned on the support arms when they are in their lowered position. Further, the pivot bracket 134 may be moved in order to adjust the height and position of the platform upon which the object is being supported.

By virtue of the angular relationship of the pivot axes of the support arms, the support arms can be moved from their second position, where they are in generally diverging relationship, to their first position, wherein the distal portions of the support arms are positioned much more closely together than when they are in their lowered position for article storage. As such, the support arms can be positioned in the raised position when the wall-mounted rack assembly is not in use, and can be similarly positioned, typically in an inverted orientation, when the storage rack assembly is positioned for display in a retail establishment for consumer purchase or for purposes of doing maintenance.

In the preferred embodiment, the proximal portion of each support arm includes a generally horizontal leg pivotally mounted on the associated mounting bracket, and a generally vertical leg, extending downwardly from the horizontal leg in the lowered position of the support arm. By this arrangement, the vertical leg of each support arm is thus positioned for engagement with the mounting bracket, in the second position of each support arm, whereby the distal portion of each support arm extends in generally cantilevered fashion from the mounting bracket. Secure, stable support of articles to be stored on the rack assembly is thus achieved.

With continued reference to FIG. 1, the rack 100 may further comprise a platform 130. In accordance with the present disclosure, the platform 130 may be configured to move between a first position and a second position. In the preferred embodiment, the platform is configurable to be adjusted for all canted-base plates. The platform 130 further comprises a set of exterior edges 132. The exterior edges 132 of the platform define an angled region raised at an obtuse angle with respect to platform 130.

With continued reference to FIG. 1, the rack 100 may further comprise a foam pad 140 affixed to the platform 130. It is contemplated that the foam pad provides increased grip between the bottom of the RC vehicle and the platform. In some embodiments, the foam pad is affixed to the platform via an adhesive pad. In other embodiments, the foam pad is affixed to the platform using adhesive Velcro pads. It is contemplated that using Velcro pads may increase the speed and ease of replacing foam pads when necessary due to wear and tear over time.

In some embodiments, the platform 130 may be H-shaped. It is contemplated that an H-shaped platform may provide a number of advantages described herein the present disclosure. For example, an H-shaped platform may accommodate vehicles with linked suspensions or trailing arms, allowing them to drop down below the platform as to not interfere with the full contact of the flat surface on the underside of the vehicle. Furthermore, the H-shaped platform may serve to plant and stabilize the vehicle. Furthermore, the H-shaped platform may also help in case of accidental contact and may arrest the potential of the vehicle tipping beyond the point where the vehicle can fall off the stand. Even further, the H-shape may also help maximize the contact area and tipping protection for flat bottom vehicles with independent suspension. It is contemplated that an H-shape platform may be preferred and superior to square rectangular and rounded shape surfaces for securing a stable resting place for vehicles.

With continued reference to the figures, each arm 120 may comprise of two proximal bolt openings 126*a* and two distal bolt openings 126*b*. As described in greater detail herein the present disclosure, to configure the assembly into a wall mount mode position, one proximal opening 126*a* and one distal opening 126*b* from each arm 120 is used. Further, to configure the assembly into a tabletop mode position, both the proximal openings 126*a* from each arm 120 is used.

In the preferred embodiments, the distal portion of each support arm defines a recessed region, which may be generally accurately configured, for accommodating support of a backpack, radio of hobby vehicle, or an associated article. In some embodiments, recess may be accurately configured to hold adventure backpacks and radios by their lanyards. In some embodiments, each support arm defines a recessed configurable as a bottle opener.

With continued reference to FIGS. 2-5, the assembly 100 is shown in the wall mount mode position. In the wall mount mode position, the platform 130 may be secured to the arms 120 using one proximal opening 126*a* and one distal opening 126*b* disposed on each arm to secure the platform 130 to the arms 120. Accordingly, a hex bolt may be driven into one proximal opening 126*a* and one distal opening 126*b* of each arm and through each platform opening 136 of the platform 130. Furthermore, the bolt may be loosened in order to adjust the platform 130, and may be tightened to secure the platform 130 in a fixed position.

With reference to FIG. 5, the storage rack assembly is shown in wall-mount mode position configured to be mounted to a wall or similar mounting surface. As shown in FIG. 5, the platform 130 is shown coupled to a proximal portion of the support arms 120 and the base 110 is shown coupled to a distal portion of the support arms 120. Further, the support arms 120 are shown coupled to the base 110 via a support bracket 114. In the illustrated embodiment, the support bracket 114 comprises a pair of generally planar surfaces arranged in an angular relationship with respect to the base 110.

In the preferred embodiment, the wall mounted storage rack may also be configured as a table surface stand. Accordingly, the platform may be adjusted in order so that the platform becomes perpendicular with respect to the support arms. When the platform is perpendicular with respect to the support arms, then the storage rack is configured in a table stand mode position adapted for resting on a table surface.

Figure 6:
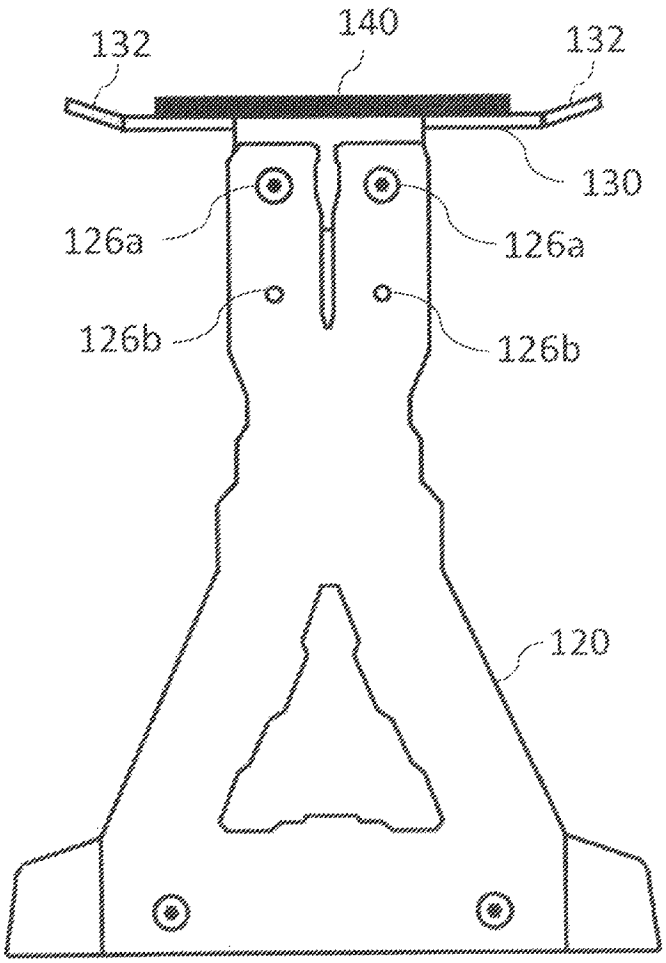
FIG. 6 is a diagram illustrating a side view of an exemplary wall mounted storage rack configured in a tabletop mode position resting on a table surface.
Figure 7:
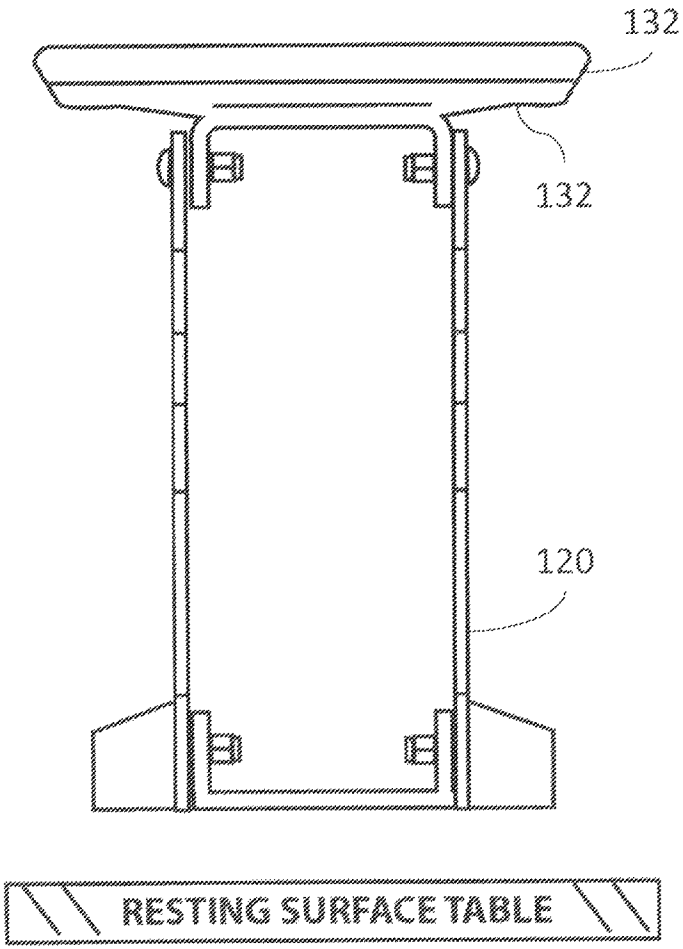
FIG. 7 is diagram illustrating another side view of an exemplary wall mounted storage rack configured in a tabletop mode position resting on a table surface.
Figure 8:
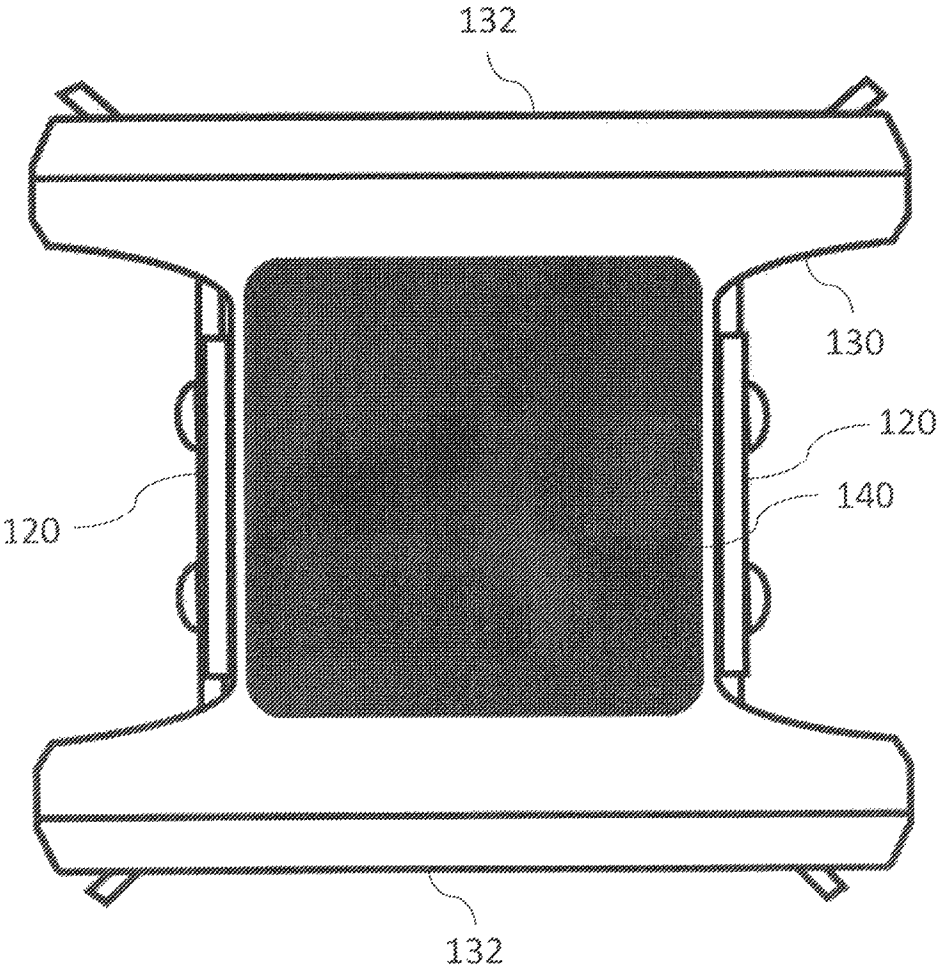
FIG. 8 is a diagram illustrating a top of an exemplary wall mounted storage rack configured in a tabletop mode position mounted to a wall surface.

FIG. 6 is a diagram illustrating a side view of an exemplary wall mounted storage rack configured in a table stand mode position resting on a table surface;

FIG. 7 is a diagram illustrating another side view of an exemplary wall mounted storage rack configured in a table stand mode position resting on a table surface; and FIG. 8 is a diagram illustrating a top view of the assembly configured in a tabletop mode position resting on a table surface.

With continued reference to FIGS, 6-8, the assembly is shown configured in a tabletop mode position resting on a table surface. In the tabletop mode position, the platform 130 may be secured to the arms by using the two proximal openings 126*a* disposed on each arm 120. Accordingly, a hex bolt may be driven through the arm proximal openings 126*a* and the platform openings 136, securing the platform 130 to the set of arms 120 in a fixed adjustable relationship. Furthermore, the bolt may be loosened in order to the adjust the platform, and the bolt may be tightened to secure the platform 130 in a fixed position in relation to the arms 120.

In some embodiments, the assembly is manufactured as separate elements that may be affixed together to form a single unitary embodiment. In the preferred embodiment, the assembly is affixed together using screws. Accordingly, the cradle is affixed to the support arms using screws. Further, the baseplate is affixed to the support arms using screws. In some other embodiments, the assembly is manufactured from a single continuous piece of metal or other suitable material.

In some embodiments, the rack 100 may further comprise a vehicle leash. The vehicle leash may be configurable to attach to an RC vehicle so to prevent the RC vehicle from falling off the platform in case the vehicle is accidently touched or bumped. With reference to FIG. 2C, a vehicle leash 150 is shown attached the storage rack assembly 100.

In some embodiments, the rack 100 further includes an optical sensor comprising a photoresistor, wherein the sensor configured to detect whether a vehicle has moved from its resting position on the cradle. A photoresistor is a passive component that decreases resistance with respect to receiving luminosity on the component's sensitive surface. The resistance of a photoresistor may decrease with increase in incident light intensity. Accordingly, when the vehicle has moved out of position of the photoresistor, the sensor may detect the movement and send a signal to alert a person that the vehicle has moved. With reference to FIG. 5B, the storage rack assembly 100 is shown including an optical sensor 160.

In some embodiments, the rack 100 may further comprise of multiple platforms to support multiple vehicles. In some embodiments, the wall base may be coupled to multiple horizontal storage surfaces.

While the term "storage rack" is used to describe the invention as a whole, it is contemplated that other similar terms including "assembly" and the like may be used interchangeably without departing from the spirit and scope of the present invention. Accordingly, the present invention is a means for storing, displaying, and protecting scale vehicles, that is designed to be configurable between a wall mount position mode wherein the invention may be affixed to a wall surface, and a tabletop mode position wherein the invention may rest on a tabletop surface.

While the term "arms" is used to describe the supporting structure operably connecting the wall mounted base to the platform, it is contemplated that other suitable supporting structures may be used without departing from the scope and spirit of the invention described in the present disclosure. In some embodiments, the supporting structure may be a single arm or structure. In some embodiments, the supporting structure may be a single piece of metal bent at an appropriate desirable angle. In some other embodiments, the supporting structure may include more than two arms or supporting structures. The terms "arms" and "supporting structure" shall both be construed to refer to any suitable supporting structure configurable to operably connect the wall mounted base to the vehicle platform.

While the term "platform" is used to describe the area that supports the vehicle, it is contemplated that similar terms including "cradle" and the like may be used interchangeably without departing front the spirit and scope of the present invention.

While the term "scale vehicle" is used to describe the object that is being supported on the platform, it is contemplated that similar terms including "vehicle", "hobby vehicle", "RC vehicle", "collectible", and the like may be used interchangeably without departing from the spirit and scope of the present invention. Accordingly, the present invention is configurable to store, display, and protect any object. The present invention is especially well adapted for static and remote control scale vehicles due to the unique design of the assembly.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. Furthermore, the foregoing describes the invention in terms of embodiments foreseen by the inventor for which an enabling description was available, notwithstanding that insubstantial modifications of the invention, not presently foreseen, may nonetheless represent equivalents thereto.

What is claimed is:

1. A storage rack assembly configured for mounting to a wall surface, the assembly comprising:

a mounting bracket comprising an outer surface configured to affix to the wall surface and an inner surface opposite the outer surface;

a set of support arms configured to extend in a generally diverging relationship from the mounting bracket; and a platform comprising an upper surface and a lower surface;

wherein the platform is configured for independent pivotal movement with respect to the mounting bracket about respective pivot axes arranged in angular relationship to each other;

wherein the mounting bracket comprises a base plate, and a support bracket secured to the base plate and the support arms;

wherein a pivot bracket defines a pair of generally planar surfaces arranged at an angle with respect to the platform;

wherein the mounting bracket comprises a first mounting region and a second mounting region spaced from each other along the mounting bracket;

wherein the platform defines a H-shaped generally planar surface for resting an object; and wherein the platform comprises a set of exterior edges defining an angled region raised at an obtuse angle with respect to the platform.

2. The storage rack assembly of claim 1, wherein the assembly is configurable to adjust between a wall mount position mode and a tabletop position mode.

3. The storage rack assembly of claim 1, wherein the assembly further comprises a vehicle leash configurable to attach to a vehicle resting on the platform.

4. The storage rack assembly of claim 1, wherein each support arm defines a recessed region configured as a bottle opener.

5. The storage rack assembly of claim 1, wherein each support arm is generally triangular in shape.

6. The storage rack assembly of claim 5, wherein each support defines a generally triangular shaped aperture.

7. The storage rack assembly of claim 1, wherein the assembly further comprises a plurality of platforms.

8. The storage rack assembly of claim 1, wherein the assembly further comprises an optical sensor configured to detect if an object has moved from its position.

9. The storage rack assembly of claim 1, wherein the platform comprises a foam pad affixed to the upper surface of the platform to provide greater stability to the object resting on the platform.

* * * * *